US006658978B1

(12) United States Patent
Johnson

(10) Patent No.: US 6,658,978 B1
(45) Date of Patent: Dec. 9, 2003

(54) STEEL RULE DIE WITH REMOVABLE CUTTING UNITS

(75) Inventor: Michael J. Johnson, El Paso, TX (US)

(73) Assignee: Ontario Die International Inc., Kitchener (CA)

( * ) Notice: Subject to any disclaimer, the term of this patent is extended or adjusted under 35 U.S.C. 154(b) by 0 days.

(21) Appl. No.: 09/418,565

(22) Filed: Oct. 15, 1999

(51) Int. Cl.[7] ..... B26D 7/26; B26F 1/44

(52) U.S. Cl. ..... 83/699.11; 83/691; 83/697; 83/698.71; 76/107.8

(58) Field of Search ..... 76/107.8; 83/699.11, 83/698.11, 698.71, 697, 698.41, 522.24, 691

(56) References Cited

U.S. PATENT DOCUMENTS

| | | | | | |
|---|---|---|---|---|---|
| 341,204 | A | | 5/1886 | Adler | 83/684 |
| 518,596 | A | | 4/1894 | Gibbs | 83/684 |
| 528,240 | A | * | 10/1894 | Sievert | 83/698.71 X |
| 1,018,520 | A | * | 2/1912 | Prime | 76/107.8 |
| 1,177,055 | A | | 3/1916 | Zimmerman | 47/72 |
| 1,321,896 | A | | 11/1919 | Davis | 83/652 |
| 1,646,413 | A | | 10/1927 | Lossman | 101/368 |
| 1,737,500 | A | | 11/1929 | Johnson | 451/442 |
| 2,097,693 | A | | 11/1937 | Foster | 83/652 |
| 2,313,801 | A | | 3/1943 | Carll | 83/691 |
| 2,395,083 | A | | 2/1946 | Wilson | 83/138 |
| 2,550,299 | A | | 4/1951 | Sabo | 83/522.15 |
| 2,588,809 | A | | 3/1952 | Demarest | 83/610 |
| 2,899,849 | A | * | 8/1959 | Laughter et al. | 76/107.8 |
| 3,048,069 | A | | 8/1962 | Berlin et al. | 83/123 |
| 3,049,039 | A | | 8/1962 | Wright | 83/652 |
| 3,111,877 | A | | 11/1963 | Rugenstein | 83/657 |
| 3,170,342 | A | * | 2/1965 | Downie | 76/107.8 |
| 3,188,900 | A | * | 6/1965 | Mauro | 83/698.41 X |
| 3,205,750 | A | | 9/1965 | Strange | 83/660 |
| 3,335,628 | A | | 8/1967 | Simms et al. | 83/652 |
| 3,340,758 | A | | 9/1967 | Peterson et al. | 83/697 |
| 3,352,187 | A | | 11/1967 | Knight | 83/657 |
| 3,373,643 | A | | 3/1968 | Spengler | 83/620 |
| 3,411,208 | A | | 11/1968 | Malm | 30/350 |
| 3,599,520 | A | | 8/1971 | Wood | 83/32 |
| 3,626,799 | A | | 12/1971 | Gerber et al. | 83/102 |
| 3,635,115 | A | | 1/1972 | Rickenbacher | 83/696 |
| 3,705,526 | A | * | 12/1972 | Bishop | 83/698.41 X |

(List continued on next page.)

FOREIGN PATENT DOCUMENTS

| | | |
|---|---|---|
| DE | 4304030 | 8/1994 |
| WO | 8906184 | 7/1989 |
| WO | 98/09781 | 3/1998 |

*Primary Examiner*—Charles Goodman
(74) *Attorney, Agent, or Firm*—Bereskin & Parr

(57) ABSTRACT

A steel rule die for cutting cloth and synthetic materials. The cutting die includes a primary substrate and a plurality of cutting units that are removably attachable to the substrate in such a manner that they are easy to adjust, remove and replace. The cutting units include secondary substrates with lengths of steel rule attached to them. The cutting units are secured to the primary substrate. Each steel rule is fixedly attached to a secondary substrate that is substantially harder than the primary substrate. The secondary substrate distributes the cutting load applied to the rule over a large surface area on the primary substrate to prevent the cutting units from diving into the soft primary substrate. Substantially the entire length of the steel rule is supported by the secondary substrate, thereby yielding a rigid cutting unit that is not susceptible to deformation. The cutting units can also include bent internal cutting sections and adjustable and removable internal cutting units that allow scrap material to flow through the cutting die. Moreover, the secondary substrates can include openings for reducing the overall weight of the die without effecting the support it provides to the steel rule.

19 Claims, 8 Drawing Sheets

U.S. PATENT DOCUMENTS 3,752,042 A 8/1973 Castille ..... 493/471
3,797,351 A * 3/1974 Jones, Jr. ..... 83/699.11
3,805,657 A * 4/1974 Simpson ..... 83/522.24
3,826,170 A 7/1974 Jones et al. ..... 83/657
3,882,614 A 5/1975 Albaladejo ..... 36/37 D
3,945,287 A 3/1976 Dvorak ..... 83/628
3,982,458 A 9/1976 Terasaka ..... 83/685
4,226,143 A * 10/1980 Whitecotton et al. ..... 76/107.8
4,250,786 A 2/1981 Bleich ..... 83/691
4,601,228 A 7/1986 Steadman et al. ..... 83/862
4,754,677 A 7/1988 McKindary ..... 83/697
4,829,854 A 5/1989 Kammerling-Essmann ..... 76/107.8
4,878,407 A * 11/1989 Harrison et al. ..... 83/698.41 X
4,884,484 A 12/1989 Bakermans et al. ..... 83/145
4,921,154 A 5/1990 Abe et al. ..... 225/97
4,981,061 A 1/1991 Hillock et al. ..... 83/697
5,129,295 A 7/1992 Geffros et al. ..... 83/19
5,275,076 A 1/1994 Greenwalt ..... 83/698.31
5,402,698 A 4/1995 Morrison ..... 83/39
5,515,749 A 5/1996 Sandford ..... 76/107.1
5,520,080 A 5/1996 Sandford ..... 83/698.51
5,676,032 A 10/1997 Johnson ..... 83/697
5,875,699 A * 3/1999 Koelsch ..... 83/698.41

* cited by examiner

STEEL RULE DIE WITH REMOVABLE CUTTING UNITS

BACKGROUND OF THE INVENTION

This invention relates to steel rule die cutting and more particularly to an improved multi-cavity die with movable and adjustable cutting units which can be easily and precisely spaced relative to each other and which provide even and consistent cuts.

Steel rule dies are commonly used for cutting cloth and cloth-like substances such as natural textiles and synthetic materials like vinyl. Steel rule dies are particularly advantageous in the repetitive cutting of a specific shape for use in clothing, furniture, shoes, and automotive trim panels. In brief, a steel rule cutting die typically comprises a base substrate or backing board in which grooves are cut and lengths of sharpened blade, known as steel rule, are formed to the same shape as the grooves and inserted in the grooves. The grooves are cut in the substrate in the pattern that is desired to be cut out of the material. Thus, when the steel rules are placed into the grooves, they form cutting edges in the shape of the desired patterns. These dies are used together with a cutting press that forces them against and into a stack of material in order to cut the material. Multiple layers of material can be cut with one pressing operation. Typically, one die will include several cutting unit cavities, each with a different pattern and defined by a closed length of rules that several multiple patterns can be cut during a single pass through the press. Multiple cavities on a single die are nested together in an efficient configuration to minimize scrap material.

One problem with typical steel rule dies is that, once the groove is cut into the substrate and the steel rule is placed into the groove, the cavities are permanently arranged in the die. If the pattern of one cavity needs to be modified in any respect, it is necessary to construct a completely new die at significant expense. In other words, there is no flexibility to change the patterns without performing the costly and time consuming procedure of making a whole new die. Additionally, the forces created on such a steel rule during cutting are concentrated on the narrow surface area of the rule that contacts the substrate. As a result, the steel rule is driven into the substrate during cutting operations until it can no longer perform a cutting function. Moreover, the rule can be torqued and damaged when the forces are unevenly distributed along the steel rule and only a portion of the rule is driven into the substrate.

A previous attempt at solving these problems is described in U.S. patent application Ser. No. 08/949,855 now U.S Pat. No. 5,983,766, entitled "Steel Rule Die with Removable Cutting Units and Method for Using Same" which is herein incorporated by reference. The application discloses a die which provides flexibility in die cutting patterns by making the cavities part of different cutting units that are separate from, and removably attached to, a substrate. Removal of the cutting units from the primary substrate allows cleaning of scrap material and allows the shape of the cavities to be modified. However, when the cutting units are positioned on the substrate, the spacing between steel rules of the adjacent cutting units is not controlled, and in some instances, the steel rules of adjacent cutting units may be touching each other. Under this arrangement there is a possibility that scrap material can become lodged between and deform the adjacent lengths of the steel rules.

Large cutting dies used particularly in the automotive industry contain a primary substrate made of high grade plywood. The reasons for using plywood include that it is readily available, relatively inexpensive, light weight and easily maneuvered. However, as discussed above, positioning a steel rule with a very small surface area directly on a softer wooden substrate can result in problems, such as the steel rule diving into the wooden substrate under the loads created during cutting. As a result, the height of the steel rule will decrease and eventually the die will stop cutting. This requires that the cavities be moved to another place on the substrate, thereby resulting in significant maintenance costs. In addition, when a steel rules dives unevenly into the wood, the rule will tend to bend over sideways and become damaged. Attempts have been made to add a hard coating to the plywood substrate to prevent the rule from diving into it. While this helps, it does not solve the problem.

Attempts have been made to mount movable cavities with cross braces on top of wooden primary substrates. One such attempt is disclosed in WO 98/09781 to Geffros et al. The disclosed cutting knife assembly includes a plurality of cutting units with elongated strips serving as cross braces. Each cutting unit has a cutting rule and a plurality of cross members which include mounting holes for securing the cutting unit to the substrate. However, these cross members do not extend under the rule to prevent it from diving into the wooden substrate, nor do they distribute the forces applied to the rules during the cutting process over a widened surface area that is as large or larger than a cavity bounded by the steel rule. Instead, the forces remain highly concentrated along the lengths of the rule with some of the forces being transferred to the spaced cross members. Moreover, the portions of the rule that do not dive into the substrate can cause the rule to torque and deform. The elongated shape of the cross member makes the cross braced cutting units susceptible to deformation during the mounting and subsequent cutting operations, thereby effecting the quality of the final product. Consequently, the expensive and time consuming task of disassembling the die and replacing the. substrate will need to be performed on a frequent basis.

Another problem with the current dies using replaceable cavities is internal cutouts. Material is ejected out of the top of the tool rather than through the back of the tool, requiring frequent cleaning of scrap material from the cutting die. In addition the solid cutouts are not themselves movable with respect to the outer perimeter of the cavity, thereby making adjustments and changes difficult.

SUMMARY OF THE INVENTION

The steel rule die of the present invention includes cavities formed as cutting units that are separate from, and removably attached to a primary substrate. The steel rule die comprises a first substrate and a force distributing base plate, also referred to as a secondary substrate, positioned on the first substrate. The secondary substrate has a hardness which is greater than that of the first substrate. A length of rule with an upper cutting surface is secured to the secondary substrate for cutting objects. The secondary substrate extends along and is in contact with substantially the entire length of rule. The secondary substrate prevents the length of rule from diving into the primary substrate and requiring the premature, costly replacement of the primary substrate. The secondary substrate also distributes the forces applied to the length of rule during the cutting process over at least the surface area of the first substrate that it contacts so that they are not localized at any one point on the first substrate. The secondary substrate can be made out of steel or another suitable substrate material that is harder and denser than the material of the first substrate. The secondary substrate can be sized so that it extends slightly beyond the outer sidewalk of the steel rule. The steel rule can then be welded to the secondary substrate and the secondary substrate will form the lip that spaces adjacent cavities from each other.

The present invention solves the problem of accurately and consistently spacing adjacent cutting units from each other. The die according to the present invention comprises a substrate and first and second cutting assemblies positioned on the substrate. Each cutting assembly includes a force distributing secondary substrate, a length of rule secured to the secondary substrate and a spacing member extending in a direction away from its length of rule. The spacing members of the cutting units abut each other and space the lengths of rule a predetermined distance apart. The spacing members can include small extensions, or lips, of the secondary substrates or attachable spacers which extend around the periphery of the steel rule on each cutting unit to provide the desired, predetermined spacing between the adjacent rules so that material waste is reduced and scrap material does not become lodged between adjacent rules and damage them. The width of the lip around the periphery of the steel rule is one half the width of the desired space between the outer sidewalls of the rules of adjacent cavities, i.e., one-half the rule segment spacing. According to the present invention, when two spacing members are pressed into contact with each other, the steel rule of the adjacent cutting units are accurately spaced by the predetermined and desired rule segment spacing.

In another embodiment of the present invention, the steel secondary substrate is cut out to be the same size as the steel rule. In this embodiment, the rule is secured to the secondary substrate so that the forces applied to the rule during the cutting process are transferred to the second substrate and distributed over its surface area to prevent the rule and secondary substrate from damaging the first substrate. In this case, the secondary substrate would not be oversized and the cutting unit would not include a lip for spacing adjacent cavities from each other. In this embodiment, the spacing member would include an attachable spacer such as a tube, a wire or a gasket which is affixed around the periphery of each cutting, unit for providing a predetermined rule segment spacing between adjacent cutting units. The spacing member would have a width equal to one half the width of the desired, predetermined rule segment spacing between side surfaces of the adjacent rules. The spacing members of these embodiments ensure a consistent distance between adjacent cavities.

In another embodiment according to the present invention, the die comprises a substrate including at least one relief opening having a width for receiving scrap material. The die also includes a cutting assembly comprising a force distributing secondary substrate having an opening including a width for aligning with the relief opening in the substrate. A length of rule is secured to the secondary substrate and at least one cutting member is spaced from an edge of said secondary substrate by the length of rule and secured relative to the secondary substrate. The cutting member includes an upper cutting edge having an opening for communicating with the opening in the secondary substrate and the relief opening. The width of the relief opening is larger than the width of the opening in the secondary substrate so that scrap materials which pass through the cutting assembly will also pass through the relief opening without becoming lodged in the die.

The die according to the present invention also includes a substrate and a cutting assembly positioned on the substrate. The cutting assembly has a force distributing secondary substrate, a length of rule secured to the secondary substrate, and a plurality of openings in the secondary substrate. Each opening forms a fluid channel for exhausting air from within the cutting cavity. Moreover, these openings provide the manufacturer with visual markers and indicators for the location of a maker notch in the length of rule. Typically, the notch is vertically aligned with one of the openings in the secondary substrate.

It is an objective of the present invention to provide a multi-cavity die with cavities that can be moved relative to each other to allow cleaning of scrap material between cutting operations, wherein adjacent cavities are spaced by a consistent predetermined rule segment spacing.

It is a further objective of the present invention to provide a multi-cavity die wherein the cavities can be removed and replaced with cavities of different shapes.

It is a further objective of the present invention to provide a multi-cavity die wherein the cavities can be quickly and easily loosened or removed from their primary substrate and wherein the rule segment spacing between adjacent cavities will be precisely maintained when the cavities are replaced.

It is a further objective of the present invention to provide a multi-cavity die wherein the cutting units are attached to a secondary substrate in such a way as to increase the surface area which carries the load applied to the rule and, which is in contact with the primary substrate to prevent the rule from embedding into the primary substrate. At the same time, the present invention provides for a more rigid cutting unit that will not deform.

It is a further objective of the present invention to provide for internal cutouts that will allow for scrap material to pass through the die as well as being adjustable with respect to the cutting unit perimeter.

The foregoing and other objects and advantages of the invention will be more fully understood from the following detailed description of the invention and from the accompanying drawings.

DETAILED DESCRIPTION OF THE INVENTION

Figure 1:
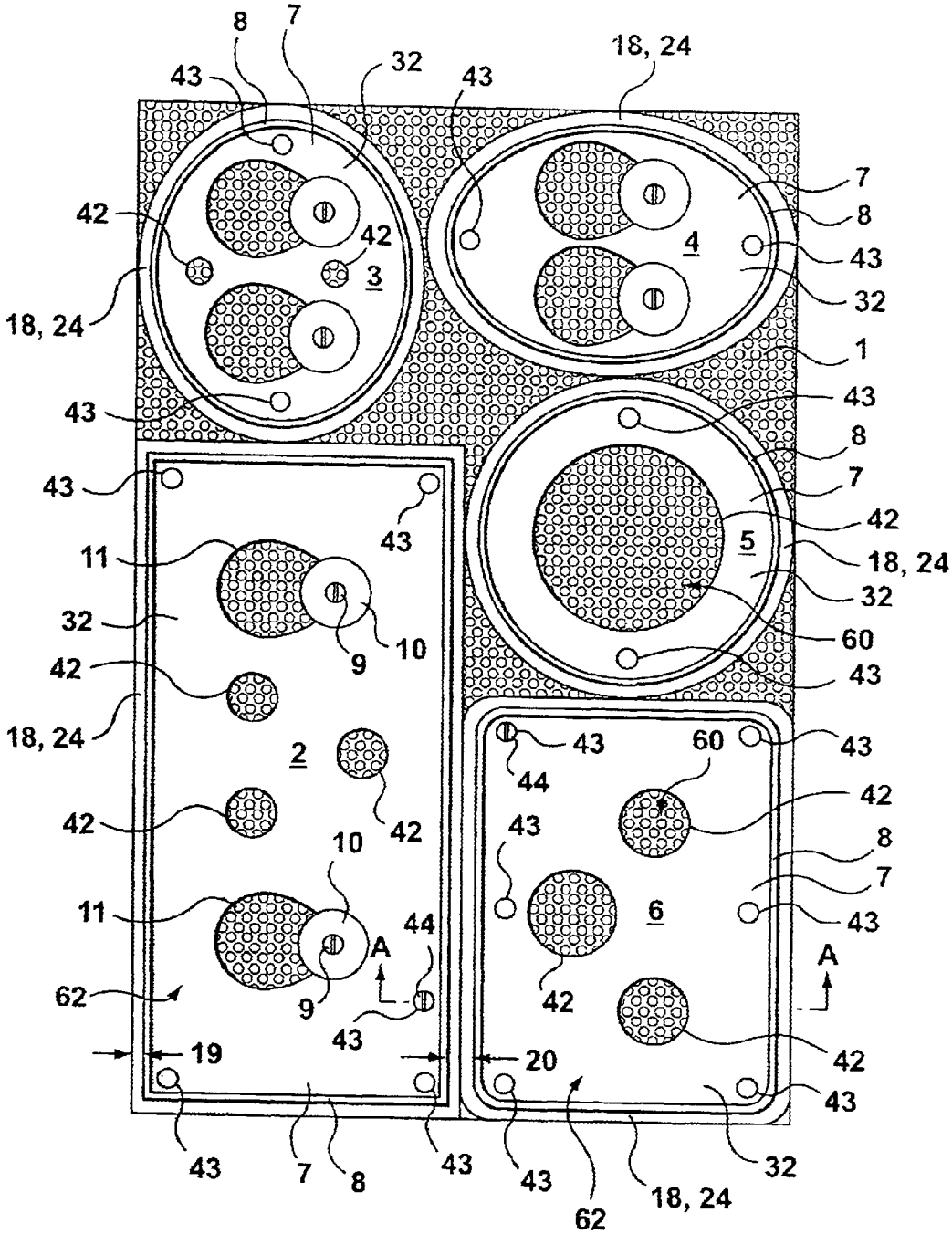
FIG. 1 is a plan view of a die with removable cavities according to the present invention.

As shown in FIG. 1, the die of the present invention has a primary substrate 1 and a plurality of cutting units 2–6 attached thereto. The primary substrate 1 lies in a plane and is preferably a board made from plywood, maple wood, beech wood or any other suitable material. Plywood is one preferred material because it is readily available, easy to handle and inexpensive. However, the primary substrate 1 could also include plural material layers, such as composite materials extending over the top and/or bottom surfaces of a wooded base. For reference purposes, the plane of the primary substrate 1 is defined as being horizontal.

Each cutting unit 2–6 consists of a force distributing base plate 7, herein after referred to as the secondary substrate, with lengths of steel rule 8 attached thereto, as shown in FIG. 1. During the manufacturing of a steel rule die, a template in the shape of the cavity is used to accurately bend the steel rule into the appropriate shape. The template for bending steel rule is usually made out of steel or another metal, and is typically referred to as the "tin." A tin is cut into the precise shape and dimensions for the cavity and the steel rule is bent around the periphery of the tin. The bent rule can then be secured to the secondary substrate. Alternatively, the rule 8 can be secured to the secondary substrate 7 as it is being bent.

The secondary substrates 7 can be constructed as a solid plate of steel, hardwood or other suitable materials. The materials used for the secondary substrate 7 are preferably harder than the materials used for the primary substrate 1 and prevent the rule 8 from diving into the secondary substrate 7 when a load is applied to the rule 8 during a cutting procedure. To reduce the weight of the larger primary substrate 1 and make it easier to handle, the materials of the primary substrate 1 have a lower density than the materials of the secondary substrate 7. For example, the approximate densities for maple wood and beech wood, which can each be used for the primary substrate, are 690 g/cm$^3$ and 670 g/cm$^3$, respectively. Whereas, the approximate densities of secondary substrate materials such as steel and aluminum are 7,800 g/cm$^3$ and 2,600 g/cm$^3$, respectively. Thus to obtain the benefits of a light weight, easily maneuverable primary substrate and a hard secondary substrate, in a preferred embodiment, the relative approximate density of the primary substrate's material should be 30% or less than the density of the secondary substrate's material. In another preferred embodiment, the relative approximate density of the primary substrate's material should be 15% or less than the density of the secondary substrate's material. While specific materials have been discussed, other materials which provide these advantages can also be used for the substrates.

The surface area of each secondary substrate 7 is greater than the surface area of a portion 30 of the rule 8 that contacts it. As shown in the figures, the secondary substrate extends along and contacts substantially all of the rule 8 while supporting it. As the rule 8 is pressed against the secondary substrate 7, the force of the load is distributed over the surface area of the secondary substrate 7 and then to the portion of the primary substrate 1 contacting the secondary substrate 7. This distribution of the load reduces the magnitude of the load applied to any one location on the primary substrate 1, thereby preventing damage to the primary substrate 1. Therefore, along with preventing the rule 8 from diving into the secondary substrate 7, the hard secondary substrate 7 also reduces the magnitude and effect of a cutting load applied to the rule 8 on the primary substrate 1. The secondary substrates 7 have a thickness substantially between 0.05 and 0.255 inch. A preferred thickness is between 0.095 and 0.130 inch, with a more preferred thickness being substantially 0.115 inch.

Each secondary substrate 7 can include one or more openings 42 for reducing the overall weight of its cutting unit and the die and, thereby, increase the maneuverability of the die. Each opening 42 has a substrate void area 60 which extends along a substantially horizontal substrate plane that is parallel to a substantially horizontal cutting cavity plane. Each cutting cavity 32 includes a cutting cavity area 62 which is the area of the cutting cavity 32 that extends along the cutting cavity plane within the rule 8. The cutting cavity plane extends substantially parallel to the primary substrate 1 and substantially perpendicular to the height of the rule 8. The substrate void areas 60 of the openings 42 can form a significant portion of the cutting cavity area 62. For example, in a preferred embodiment, the total substrate voided area 60 along the substrate plane created by the opening(s) 42 can be approximately 70% or greater of the cutting cavity area 62 along the cutting cavity plane. It is also contemplated that the substrate voided area of a single opening 42, such as the opening shown in cutting unit 5 in FIG. 1, or the aggregate substrate voided areas 60 of a plurality of openings 42, such as those shown in cutting unit 6 in FIG. 1, could be in the range of between approximately 10% to 80% of the cutting cavity area 62. All percentages within this range are contemplated. While these openings 42 are shown in only some of the cutting units, it is contemplated that they could be used with each cutting unit disclosed herein.

Figure 5:
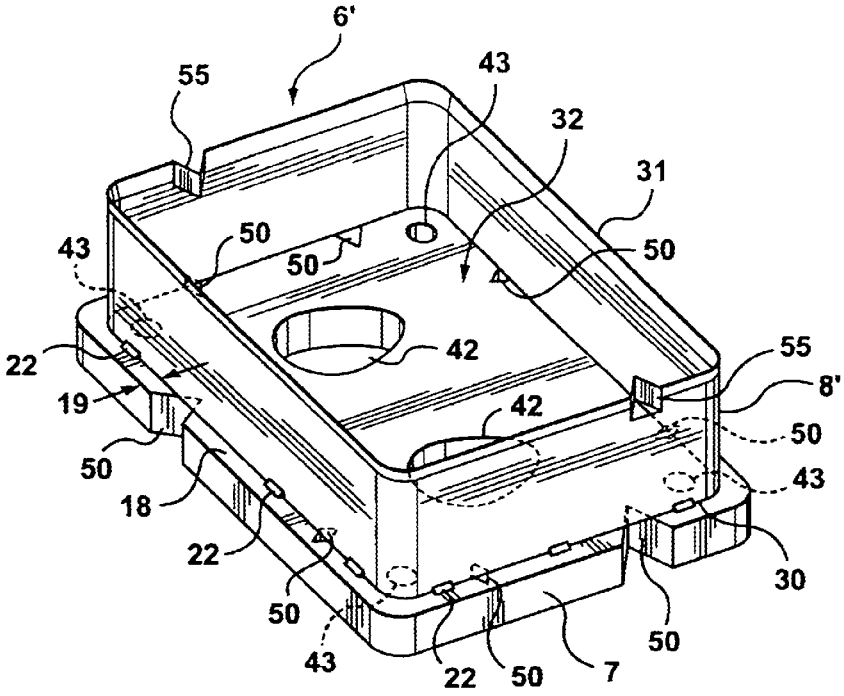
FIG. 5 is an isometric view of a cutting unit according to a second embodiment of the present invention having an alternative hole pattern in the secondary substrate to that shown in FIG. 1.

Each of the pieces of steel rule 8 has a first end 30 which is attached to its secondary substrate 7 and an opposite end with a sharpened edge 31 which extends in a direction away from the secondary substrate 7 for cutting patterns in a shape corresponding to the shape of the rule 8. The sharpened edge 31 can have any desired shape including the offset bevel as disclosed in U.S. Pat. No. 5,676,032 entitled "Steel Rule Die with Closely Nested Cavities" which is hereby incorporated by reference. The steel rule 8 attached to each secondary substrate 7 forms the cutting peripheries of each cutting unit 2–6. The raised cutting edges 31 of each cutting unit 2–6 form a recessed section or cutting cavity 32 that is bounded by its rule 8 and into which the stamped material enters after it is cut from its sheet. The steel rule 8 can also include marker notches 55 formed in its top portion, as shown in FIG. 5. Such notches are described and shown in U.S. Pat. No. 5,676,032. While the marker notches 55 shown in FIG. 5 have the same shape as those shown in FIGS. 13 and 15 of U.S. Pat. No. 5,676,032, they may also include other shapes. Additionally, these marker notches 55 can be used with the steel rule of any one of the embodiments disclosed herein.

The cutting units 2–6 are each secured to the primary substrate 1 via holding devices 44 inserted through mounting holes 43 within the secondary substrate 7. Each cutting unit 2–6 includes at least two holding devices 44, such as screws, bolts or other suitable devices threaded or otherwise affixed to the primary substrate 1. In a preferred embodiment, each holding device 44 includes a threaded member for engaging an internally threaded insert 45 extending through the primary substrate 1. Threaded inserts 45 are advanced into the primary substrate through counter bored holes so that they are flush with the lower surface of the primary substrate 1. These inserts 45 can include teeth on their exterior surface for engaging with the sidewalls of their respective holes in the primary substrate 1 to prevent their rotation relative to the substrate 1. The inserts 45 can include T-nuts or other known internally threaded inserts. It is also contemplated that the internally threaded inserts 45 could be advanced through the secondary substrate 7 and the holding devices 44 could be inserted through the primary substrate 1. A small amount of play can be included between the holding devices 44 or the inserts 45 and the secondary substrate 7 so that the substrate 7 can be moved slightly relative to the fastener before being completely secured to the primary substrate 1. While only two such holding devices 44 are shown in FIG. 1, it is recognized that holding devices 44 and inserts 45 can be used for each mounting hole 43.

The secondary substrates 7 may also have enlarged holes 11 therein to further facilitate easy securing and removal of the cutting units. Holes 11 also contribute with the openings 42 to reduce the overall weight of the die. The holes 11 can have any shape. In a preferred embodiment, the holes 11 are teardrop shaped as disclosed in U.S. patent application Ser. No. 08/949,855. The holes 11 are sized and shaped so that the wide end of the hole 11 is larger than the diameter of a washer 10. This permits the washers 10 to extend through holes 11 in secondary substrate 7. Secondary substrates 7 can be horizontally translated, e.g., slid, a small amount such that washer 10 of stud 9 is situated toward the narrow end of hole 11. In this position, the washers 10 retain the secondary substrate 7 against motion perpendicular to the plane of the primary substrate 1, i.e., they retain the secondary substrate 7. against vertical movement. However, washers 10 permit secondary substrates 7 to move in a horizontal plane with respect to primary substrate 1. When the studs 9 are tightened down, the cavities are secured from movement.

When the cutting units 2, 3, 4, 5 and 6 are pushed against each other, the peripheries of the steel rule 8, 8' for adjacent cavities 32 are spaced apart from each other by a predetermined distance. In the embodiments shown in FIGS. 2–7, the secondary substrate 7 for each cutting unit 2–6 is slightly larger than its cavity 32. The portion of each substrate extending beyond the steel rule 8, 8' forms a spacing member, e.g., a lip 18, around the periphery of the cutting unit which ensures that consistent spacing between adjacent cavities is maintained. The secondary substrate 7 is fabricated so that the spacing member 18 has a precise width 19. The width 19 of each spacing member 18 is one half of the rule segment spacing. The rule segment spacing 20 is the desired distance between the outer side surfaces of adjacent rules facing each other. When two adjacent cutting units abut each other, their spacing members 18 contact each other and the steel rules 8, 8' of these cutting units are spaced apart by the rule segment spacing 20 which is equal to twice the width of the lip 18 around each cutting unit.

If a center bevel rule is used, it may be desirable to have a gap of 0.25 inch between the cutting edges 31 of adjacent rules. With such a gap, a predetermined rule segment spacing 20 of, i.e., 0.167 inch could be created between the steel rules of the adjacent cutting units. In this case, the secondary substrates 7 would be formed to have a lip 18 that is 0.0835 inch wide so as to maintain the 0.25 inch gap between the cutting edges 31 and the 0.167 inch rule segment spacing. If an offset bevel rule is used, it may be desirable to have a gap of 0.125 inch and a rule segment spacing 20 of, i.e., 0.095 inch. In that case, the secondary substrates would be formed to have lips 18 that are 0.0475 inch wide.

Figure 3:
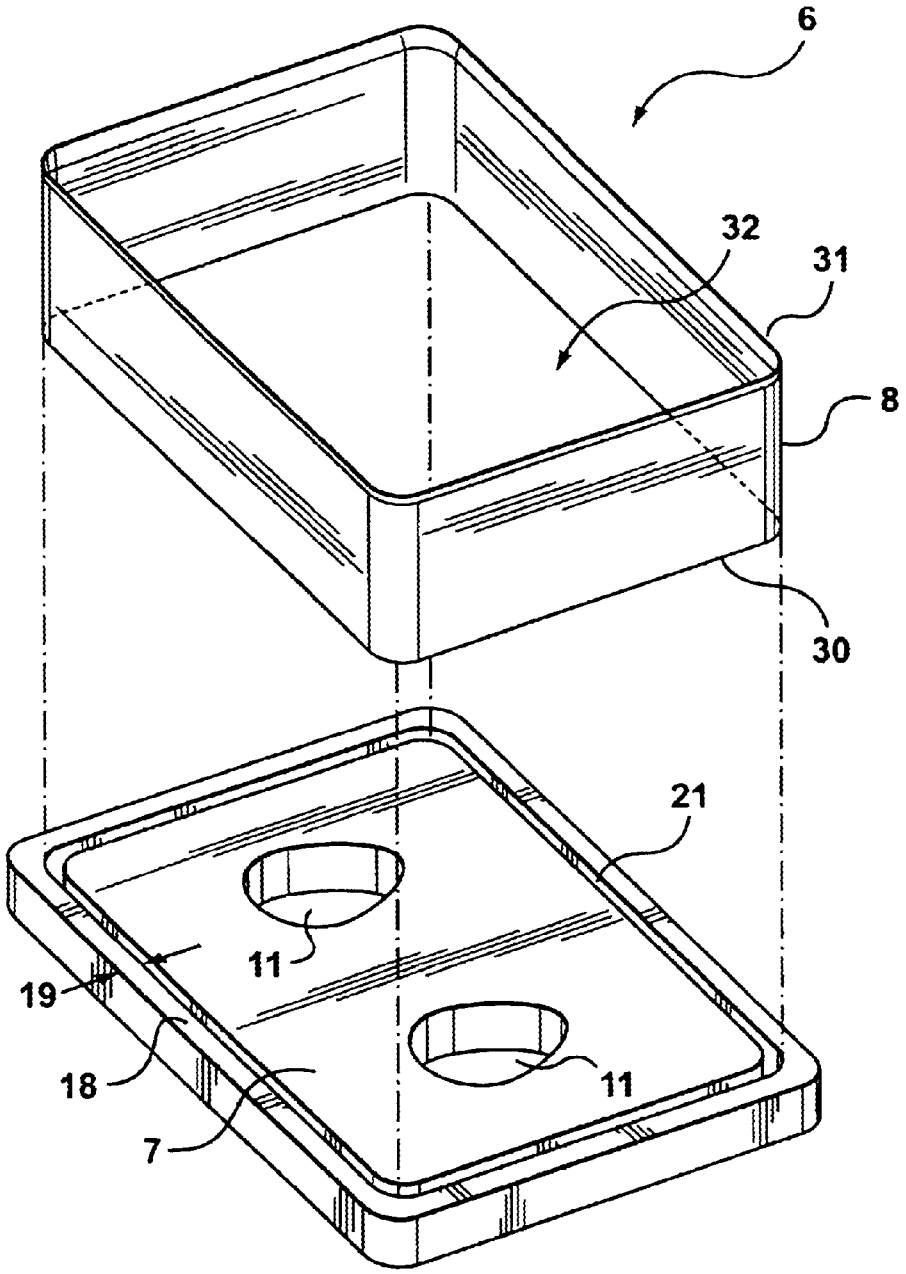
FIG. 3 is an exploded view of the cutting unit shown in FIG. 2.

In order to achieve a desired width of the lip 18 on the secondary substrate 7, the rule 8, 8' can be secured to an upper surface of the secondary substrate, as shown in FIG. 5, or positioned within a groove 21 in the secondary substrate, as shown in FIG. 3. The groove 21 can be readily cut with a router. For extra precision in cutting the groove, the groove 21 can be cut using a router in an automated X-Y computer controlled cutting table. Such a cutting table is described in U.S. Pat. No. 5,676,032. Once the groove 21 is cut into secondary substrate 7, the steel rule 8 can be inserted into the groove 21. The non-sharpened edge 30 of the steel rule 8 is inserted into the groove 21, as shown in FIG. 3, so that the sharpened edge 31 protrudes from the secondary substrate 7. If desired, the steel rule 8 can be held in the groove 21 by only friction. Alternatively, if desired, an adhesive, welds or mechanical fasteners can be used to assist with holding the steel rule 8 in the groove 21. Additionally, the secondary substrate 7 can include an air exhaust channel that communicates air from inside the cavity 32 to an area outside the cavity for venting air in the cavity to the atmosphere during a cutting procedure. This air exhaust channel could be in fluid communication with a channel in the primary substrate 1.

Figure 2:
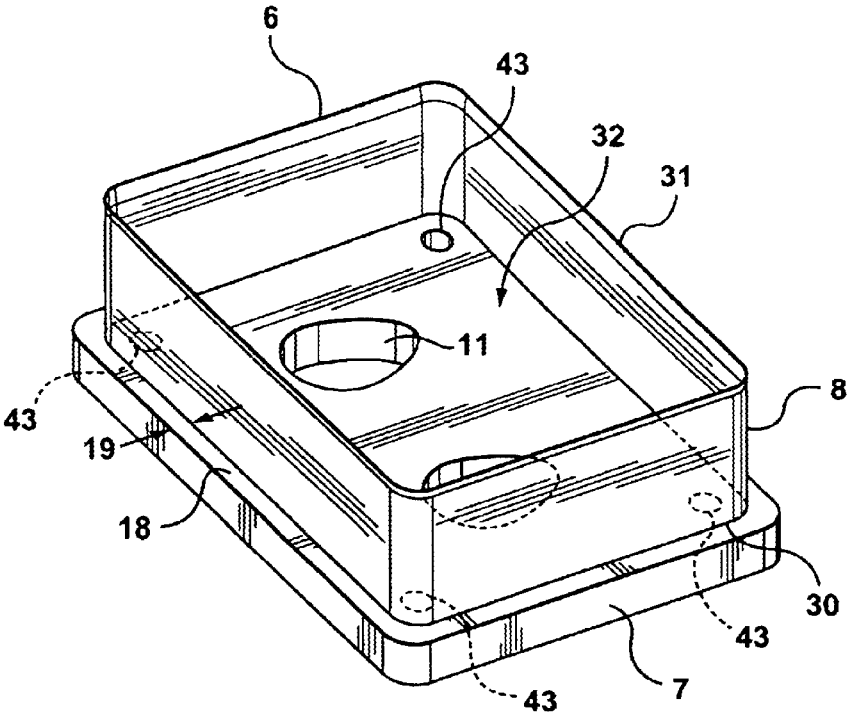
FIG. 2 is an isometric view of a cutting unit according to the first embodiment of the present invention having an alternative hole pattern in the secondary substrate to that shown in FIG. 1.
Figure 4:
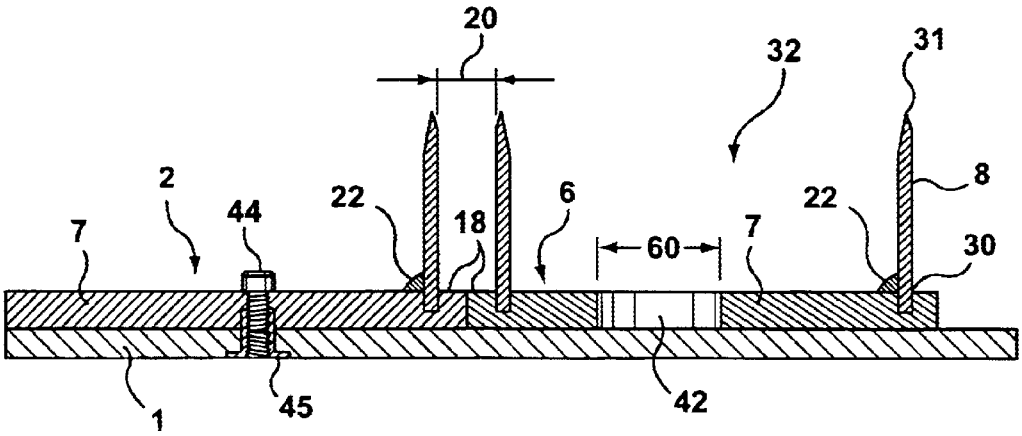
FIG. 4 is a cross-section taken along line A—A of FIG. 1 of the cutting unit shown in FIG. 2.

FIG. 4 shows a cross section of a portion of the assembled die of FIG. 2 taken along line A—A in FIG. 1. Holding devices 44 and threaded inserts 45 removably secure secondary substrate 7 to the primary substrate 1. While not shown in FIG. 4, the secondary substrates 7 may also be secured onto primary substrate 1 by attachment studs 9 to prevent movement perpendicular to the plane of the primary substrate 1. As shown in FIG. 1, the lip 18 of each cutting unit 3, 5 and 6 is in contact with the lip 18 of the adjacent cutting unit 2. The cutting edges 31 of each section of rule 8 are separated from each other by a gap of 0.25 inch for a center bevel rule and 0.125 inch for an offset bevel rule. These gaps are precisely maintained when lips 18 of adjacent cutting units abut each other.

Figure 7:
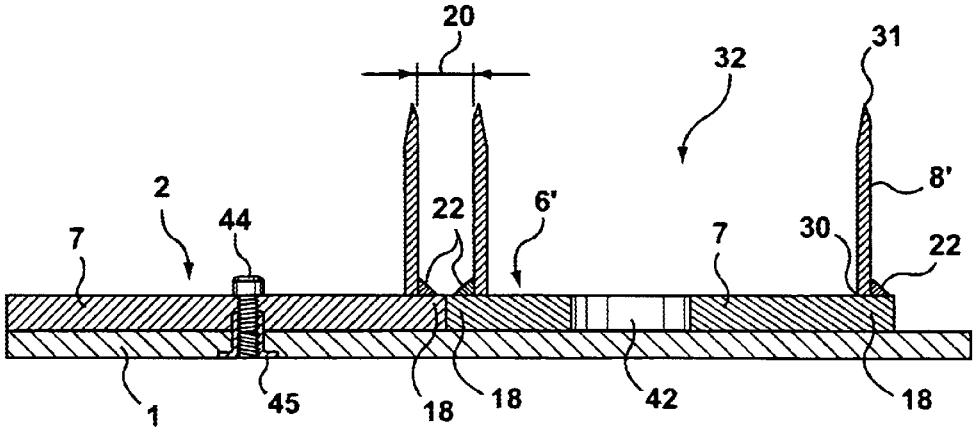
FIG. 7 is a cross-section taken along line A—A of FIG. 1 showing the cutting unit of FIG. 5.
Figure 6:
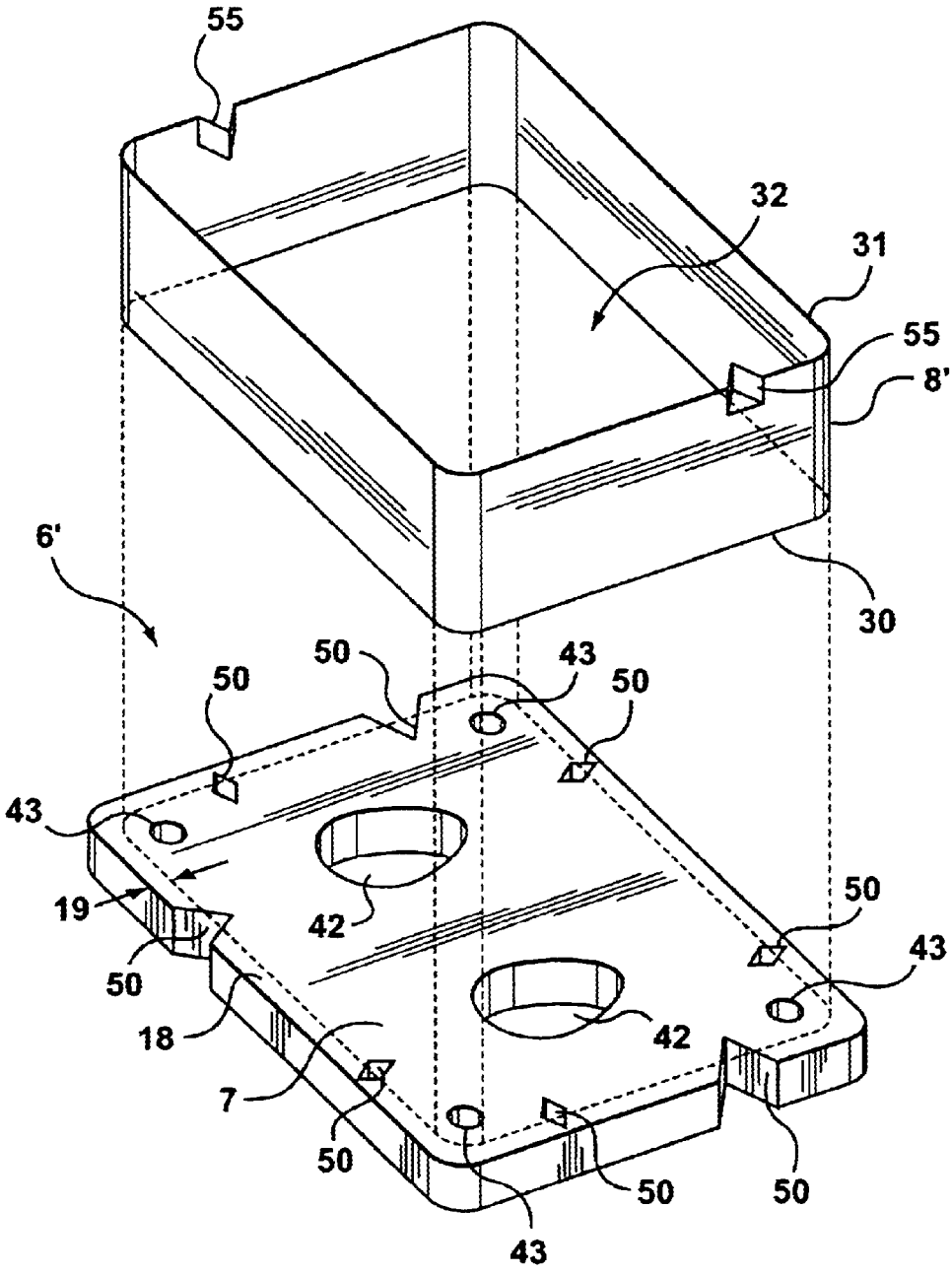
FIG. 6 is an exploded view of the cutting unit shown in FIG. 5.

A second embodiment of the cutting unit 6, herein illustrated as cutting unit 6', is shown in FIGS. 5 through 7. In this embodiment, the secondary substrate 7 is made of steel or other metals. The secondary substrate 7 is larger than the area bounded by the steel rule 8', as discussed with respect to the first embodiment, so that spacing members 18 extend along and away from the outer side surface of the steel rule 8'. However, as can be seen in FIG. 6, there is no groove cut into the secondary substrate 7. The secondary substrate 7 is formed into an appropriate shape and then the steel rule 8' is welded onto the secondary substrate 7 with welds 22. The weld 22 may be a continuous welded seam, or it can be a series of small tack welds, depending on the requirements for strength and warping of metal. Alternatively, the steel rule 8' could be attached to the secondary substrate 7 with brackets or threaded fasteners. Any method of attachment is suitable, as long as a consistent lip 18 is maintained around the cavity 32. As in the first embodiment, there can be round mounting holes 43 and/or teardrop shaped holes 11 in the secondary substrate 7 which cooperate with respective holding devices 44 and studs 9 and washers 10 to retain the cutting units against motion relative to the primary substrate 1. Optionally, more or larger openings 42 can be formed in the secondary substrate 7 to reduce its weight.

The secondary substrate 7 also includes air discharge openings 50 which extend on either side and below the rule 8'. These openings 50 provide a path for the air within the cutting cavity 32 to be expelled to the atmosphere during a cutting procedure in response to material entering the cutting cavity 32. As material enters the cutting cavity 32, the air within the cutting cavity 32 must be expelled or it will reduce the cavity's effective material receiving volume. The openings 50 are located within the secondary substrate 7 at locations spaced along the length of the cutting rule 8'. As cut material enters the cutting cavity 32, the air within the cutting cavity 32 is discharged to the atmosphere through openings 50 without having to pass along the height of the rule and thereby possibly reduce the effective volume of the cutting cavity 32 by upsetting the arrangement of stacked pieces of cut material. Additionally, the openings 50 reduce the presence of trapped air within the cutting cavity which could reduce its effective volume and increase the frequency at which the cut material must be removed from a cutting cavity 32. While the openings 50 are shown to include a V-shaped notch in the sidewalk of the secondary substrate 7, they can also include a diamond shape formed in the upper surface of the substrate as shown in FIG. 6 or any other shape which is capable of allowing the air to escape from the cutting cavity 32. Additionally, the openings 50 can be used to simplify the manufacturing process by providing the manufacturer with reference points for locating the marker notches 55. Each opening 50 can act as a visual indicator and a reminder for locating a marker notch 55 above it. As a result, during the production of the die, the manufacturer will not miss providing a marker notch 55 when he encounters on opening 50. Additionally, the openings 50 also act as alignment members for the marker notches 55. Therefore, as shown in FIG. 5, each marker notch 55 can be aligned with one of the openings 50 and formed in the steel rule 8' at a position above it.

FIG. 5 shows the steel rule 8' attached around its base to the secondary substrate 7 by welds 22. This yields a completely rigid cutting unit that cannot be deflected laterally during installation or subsequent cutting operations ensuring accurate cutting over the life of the cutting die. By adding additional welds 22 to the assembly, additional strength can be added and forces may be more evenly distributed over the surfaces of the primary and secondary substrates 1 and 7. The steel rule 8' of the embodiment shown in FIG. 5 and the other embodiments can be welded to the secondary substrate 7 along its entire length or at spaced locations. As discussed below, a similar assembly can be achieved by securing the steel rule 8 or 8' around the outer periphery of the secondary substrate 7.

FIG. 7 shows a cross section of a portion of the assembled die taken along line A—A in FIG. 1 using the cutting units of FIG. 5. As in the first embodiment, the secondary substrates 7 may be secured to primary substrate 1 by holding devices 44 and attachment studs 9 so that the lip 18 of each cutting unit 3, 5 and 6' is in contact with the lip 18 of the cutting unit 2. Lips 18 are exactly half the rule segment spacing between adjacent cutting units. As a result, the cutting edges 31 of each section of rule 8' are separated from each other by a predetermined gap, as discussed above. Since the secondary substrates 7 are made from steel, they are relatively rigid compared to the wooden primary substrate 1. As with the other embodiments according to the present invention, the rigidity of the steel substrates assist in maintaining consistent rule segment spacing between the steel rule 8' of adjacent cutting units.

Figure 8:
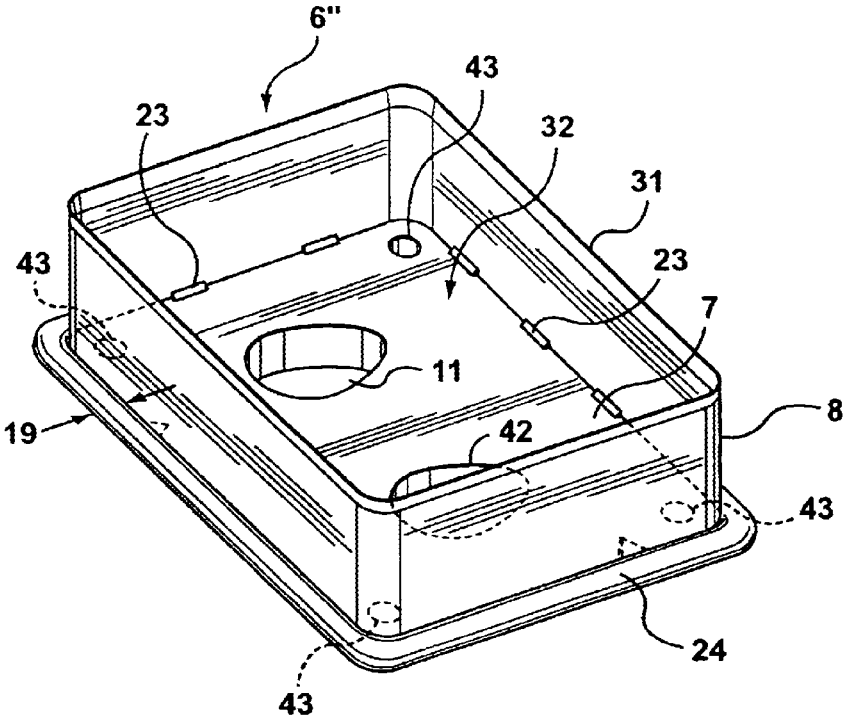
FIG. 8 is an isometric view of a cutting unit according to a third embodiment of the present invention having an alternative hole pattern in the secondary substrate to that shown in FIG. 1.
Figure 10:
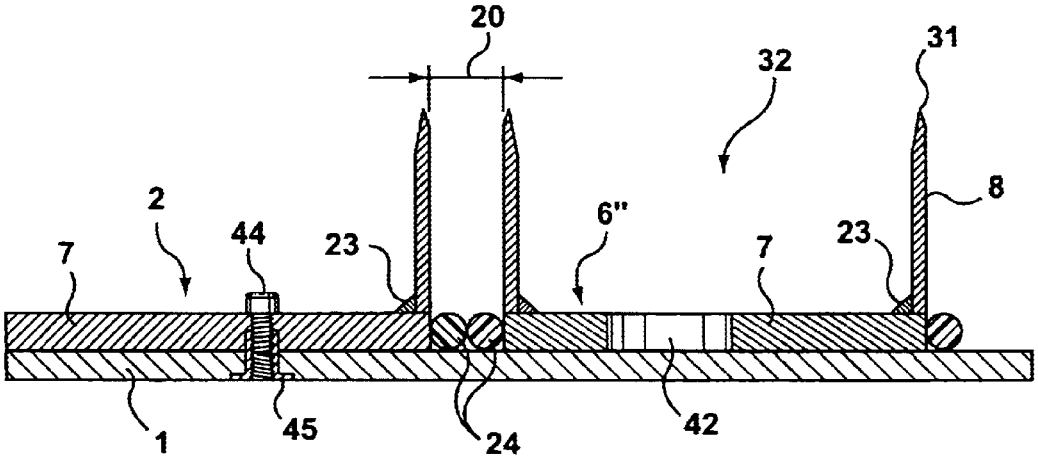
FIG. 10 is a cross-section taken along line A—A of FIG. 1 showing the cutting unit of FIG. 8.
Figure 9:
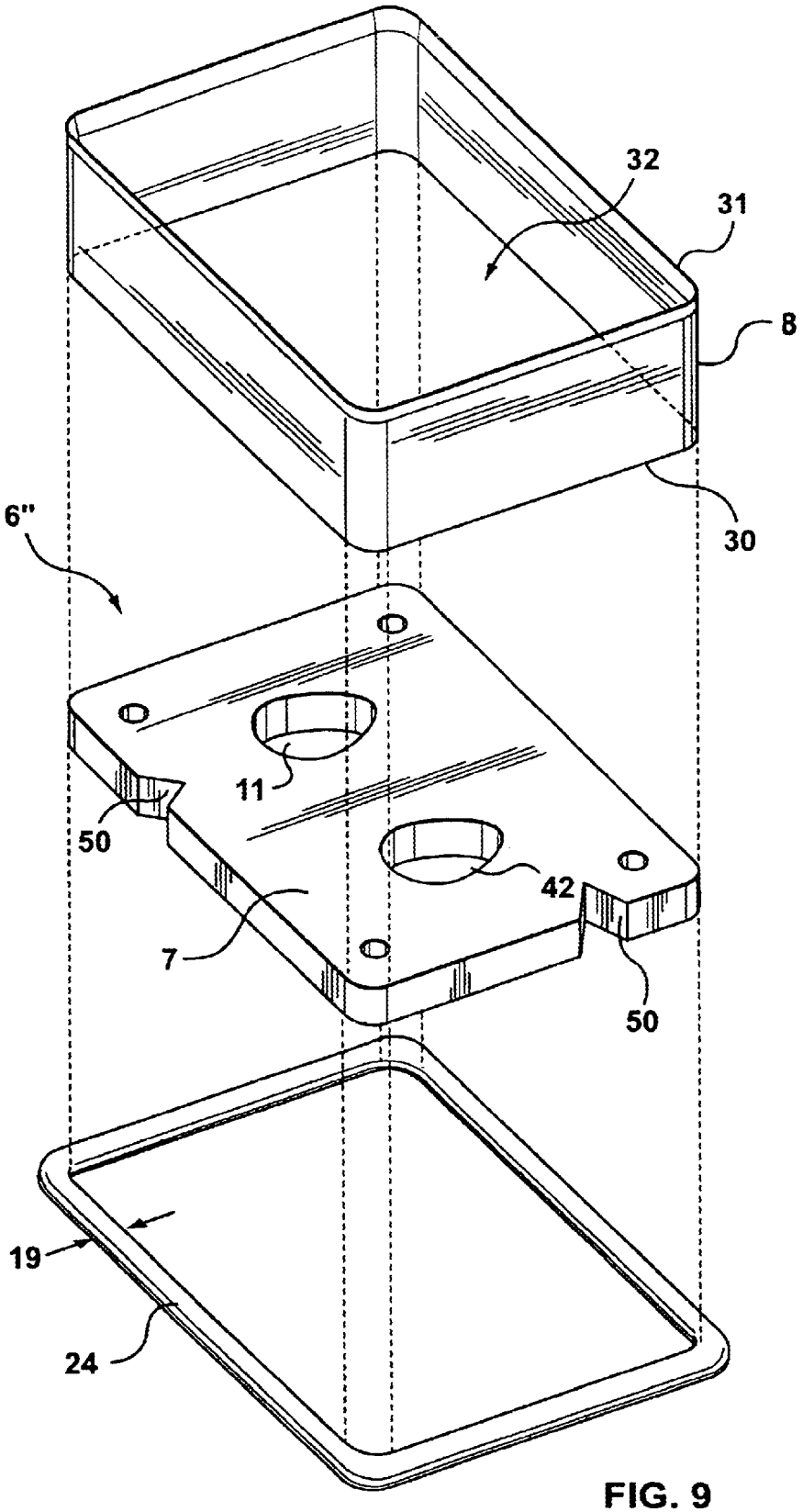
FIG. 9 is an exploded view of the cutting unit shown in FIG. 8.

A third embodiment of the cutting unit 6, herein illustrated as cutting unit 6", is shown in FIGS. 8 through 10. In the third embodiment, as in the other embodiments, the secondary substrate 7 is made of steel or other suitable metals. However, in the third embodiment, the secondary substrate 7 is formed to be slightly smaller than the cavity. The size of the secondary substrate 7 is chosen so that the steel rule 8 can snugly fit around the periphery of the secondary substrate 7 and substantially contact all of the secondary substrate 7. The steel rule 8 is fastened to the secondary substrate by welds 23 so that the forces applied to the steel rule are transferred and distributed over the surface of the secondary substrate 7. The weld 23 may be a continuous welded seam, or it can be a series of small tack welds. Alternatively, the steel rule 8 could be attached to the secondary substrate 7 with brackets or threaded fasteners. The secondary substrate 7 can also include marker notches 55 and air exhaust openings 50 which extend through the substrate to exhaust air from within the cavity 32. Openings 50 can cooperate with exhaust channels in the primary substrate 1 to vent the air within the cutting cavity 32 to the atmosphere outside the cutting cavity 32.

A rigid or compressible spacing member 24 such as a gasket, a piece of wire or a piece of tubing is fastened around the periphery of the steel rule 8 to create the predetermined distance that provides the desired rule segment spacing between the adjacent cutting-units. If a compressible spacing member is used, it should have a predictable size when in its compressed state so that precise positioning is achieved. The spacing members 24 can be secured on the steel rule 8 by friction, adhesives or other suitable means for fastening them to the outer facing surfaces of the steel rules 8. The spacing members 24 can also be removably positioned against the steel rule 8 so that they can be removed after the cutting units have been secured in their properly spaced positions. Each cutting unit 2–6" can include a spacing member 24 that is one-half the predetermined rule segment spacing. Alternatively, if the layout of the cutting units permits, alternate cutting units can include a spacing member 24 with a width equal to the desired rule segment spacing for providing the predetermined distance between the adjacent rules while the alternate cutting units do not include such a spacer.

FIG. 10 shows a cross section of a portion of the assembled die taken along line A—A in FIG. 1 using the cutting units of FIG. 8. In this third embodiment, the spacing members 24 are located on the opposite side of the steel rule 8 from the weld 23 and the secondary substrate 7. As shown in FIG. 1, the spacing members 24 for cutting units 2 and 6" are in contact with each other and they are also in contact with the steel rules 8 of their respective cutting units. The spacing members 24 act as lips around the cutting units. The rule segment spacing 20 between the steel rules of cutting units 2 and 6" is twice the width of spacing members 24. By selecting the appropriate width for the spacing members 24, the rule segment spacing between adjacent cavities can be very precisely maintained.

As with the previously discussed embodiments, the embodiments in FIGS. 7–10 provide for the steel rule 8 to be mounted to a secondary substrate. that is substantially harder than the wooden primary substrate 1. As the cutting operation takes place, forces are directed downward through the cutting edge 31 and transferred through the rule 8 to the secondary substrate 7, by the welds 23. In turn, the secondary substrate 7 transmits the load to the primary substrate 1. Because the secondary substrate 7 is harder than the primary substrate 1, the rule 8 will not dive into it and because the load is distributed over a large area between the secondary and primary substrates, the secondary substrate 7 will not dive into the primary substrate 1.

In the embodiments shown in FIGS. 2–7, the secondary substrate 7 extends directly below substantially the entire length of the rule 8 for distributing the forces applied to the rule 8 to the secondary substrate 7 in order to reduce the load applied to any one location on the primary substrate 1. In the embodiment shown in FIGS. 8–10, the rule 8 is secured to the secondary substrate at points along its length for distributing the forces applied to the rule 8 to the secondary substrate 7 so as to reduce the load applied to any one location on the primary substrate 1.

Figure 11:
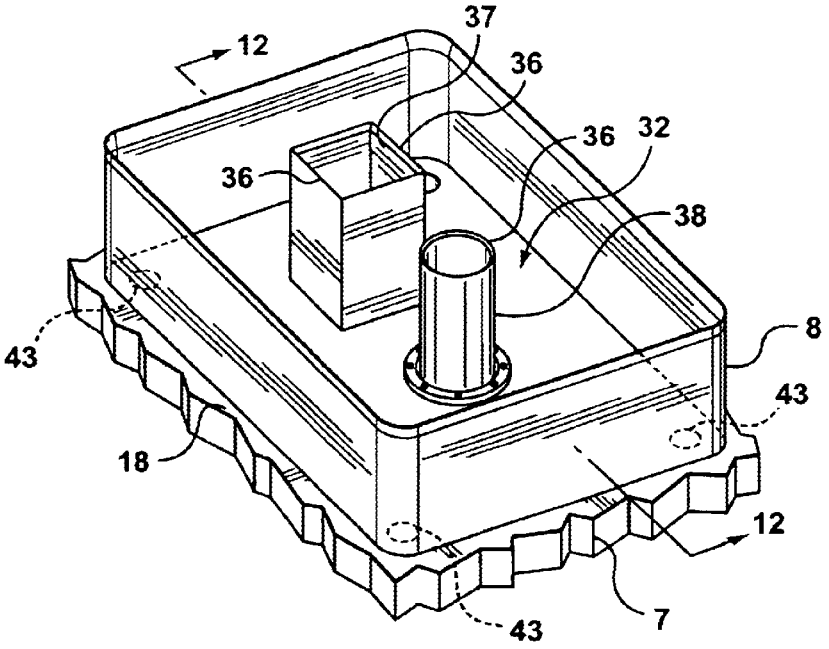
FIG. 11 is an isometric view of a cutting unit containing internal cutouts.
Figure 12:
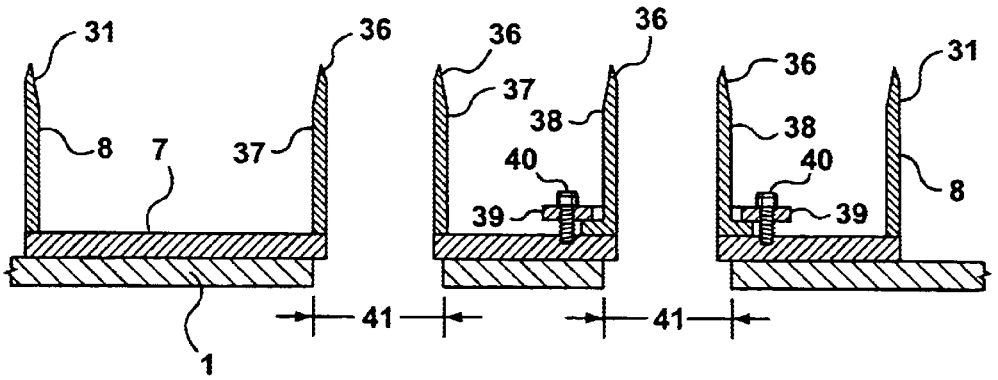
FIG. 12 is a cross section view along line 12—12 of FIG. 11.

FIG. 11 illustrates a cutting unit including internal cutouts that allow for scrap material to pass through the primary substrate 1. These internal cutouts include a bent cutout 37 and a solid cutout 38. These cutouts 37, 38 include offset bevel cutting edges 36 as discussed above with respect to the steel rule 8. These cutting edges 36 are at the same level above the secondary substrate 7 as the edge 31 of the rule 8. The bent cutout 37 is formed in the same way as the rule 8 and is attached to the secondary substrate 7 in a similar manner. The solid cutout 38 includes a machined tubular member containing a flange that is affixed to the secondary substrate 7 with a washer 39 and screws 40. The hole in the washer 39 is slightly larger than the outer diameter of the cutout 38 allowing for the cutout to be easily adjusted perpendicular to the primary substrate or replaced. FIG. 12 shows two reliefs 41 in the primary substrate 1 with widths or diameters that are substantially larger than that of the piece being cut by their respective internal cutouts 37, 38, thereby allowing for scrap material to easily pass through the cutouts 37, 38 and through the primary substrates. The support provided to the secondary substrate 7 by the primary substrate 1 allows these reliefs 41 to be larger than the cutouts 37, 38. As with the embodiments shown in FIGS. 1–10, the secondary substrate 7 of the cutting unit shown in FIGS. 11–12 can also include any of the spacing members discussed above for properly positioning adjacent cutting units relative to each other. The cutting unit can also include opening 42, air discharge openings 50 and matter notches 55.

A steel rule die has been described that provides removable cutting units to facilitate cleaning of the die between cutting operations. Because the cutting units are removable, they can easily be replaced and cavities with different shapes can be installed. When cutting units are replaced in the die, they are spaced consistently relative to each other so as to consistently maintain the predetermined rule segment spacing between the steel rules of adjacent cavities. This provides the operator of the die with the ability to quickly, easily and inexpensively replace and maintain the precise spacing between cutting units without having to reassemble the entire die. Additionally, because the steel rule is secured to the secondary substrate which extends at least substantially between the edges of the steel rule, the forces applied to the steel rule are distributed over the secondary substrate and the primary substrate so that the force at any one point along the first substrate is then that experienced by the primary substrates of the prior art dies. By reducing the forces applied to the primary substrate at any one point, the life of the primary substrate is prolonged.

While preferred embodiments of the invention have been shown and described, it will be apparent to those skilled in the art that various modifications may be made in these embodiments without departing from the scope of the invention. For example, the spacing members along different sides of the secondary substrate could extend different distances away from the rule for providing different spacing between cutting units; Also, any number of cutting units having any shape can be used with the die according to the present invention. Therefore, it is intended that the invention not be limited to the particular embodiments disclosed but that the scope of the invention be defined by the following claims.

What is claimed is:

1. A die comprising:

a substrate having a hardness;

a force distributing base plate positioned on said substrate, said base plate having a second hardness which is greater than said hardness of said substrate;

a rule with an upper cutting surface, said rule defining a periphery of a cutting cavity and being secured to said force distributing base plate; and wherein said force distributing base plate extends substantially along the entire said rule and includes a plurality of openings which permit air within a cavity formed by said rule to escape.

2. The die according to claim 1 wherein said rule is secured around a peripheral wall of said base plate.

3. The die according to claim 2 wherein said rule is welded to said base plate.

4. The die according to claim 1 wherein said base includes a spacing member for abutting against a spacing member of an adjacent base plate.

5. The die according to claim 4 wherein said spacing member has a width of 0.125 inch or less.

6. The die according to claim 4 wherein said spacing member has a width of 0.0625 inch or less.

7. A die comprising:

a substrate;

a first cutting assembly positioned on said substrate, said cutting assembly including a force distributing base plate, a length of rule secured to said base plate wherein said force distributing base plate extends substantially along the entire said rule and a spacing member extending in a direction away from said rule;

a second cutting assembly positioned on said substrate and abutting said first cutting assembly, said second cutting assembly including a force distributing base plate, a length of rule secured to said base plate of said second cutting assembly wherein said force distributing base plate extends substantially along the entire said rule and a spacing member extending from said length of rule of said second cutting assembly toward said first cutting assembly; wherein each said base plate includes a plurality of openings for allowing air from within a respective one of said cutting assemblies to escape; and wherein said spacing member of said first cutting assembly contacts said spacing member of said second cutting assembly for spacing said lengths of rule a predetermined distance apart.

8. The die according to claim 9 wherein a width of each spacing member is substantially one-half the predetermined distance between said lengths of rule.

9. The die according to claim 7 wherein each said length of rule is secured to an upper surface of a respective one of said base plates.

10. The die according to claim 9 wherein each said length of rule extends around a peripheral wall of said respective base plate.

11. The die according to claim 10 wherein each said spacing member includes a removable spacer positioned about the peripheral wall of the respective base plate.

12. The die according to claim 11 wherein each said removable spacer is secured to the respective base plate.

13. The die according to claim 9 wherein each said spacing member includes a portion of said respective base plate which extends away from said respective length of rule.

14. The die according to claim 7 wherein said substrate is formed of a first material with a first hardness and said base plates are formed of a second material with a hardness which is greater than said first hardness.

15. The die according to claim 14 wherein each said length of rule is welded to a respective one of said base plates.

16. The die according to claim 7 wherein each said spacing member has a width of 0.125 inch or less.

17. The die according to claim 7 wherein each said spacing member has a width of 0.0625 inch or less.

18. A die comprising: a substrate;

a cutting assembly positioned on said substrate, said cutting assembly including a force distributing base plate, a length of rule secured to said base plate and forming a cutting cavity, a plurality of openings in said base plate, each said opening forming a fluid channel for communicating fluid between an inside of said cavity; and an area outside of said cavity, and a notch in said length of rule vertically aligned with one of said openings in said base plate.

19. The die according to claim 18 wherein said length of rule includes additional notches each vertically aligned with one of said openings in said base plate.

* * * * *